United States Patent [19]

Bouthillier

[11] Patent Number: 4,993,338

[45] Date of Patent: Feb. 19, 1991

[54] STITCH SWITCHING MECHANISM FOR A CHAIN STITCH SEWING MACHINE

[75] Inventor: Robert Bouthillier, Dayville, Conn.

[73] Assignee: Aberdeen Manufacturing Corporation, New York, N.Y.

[21] Appl. No.: 230,868

[22] Filed: Aug. 11, 1988

Related U.S. Application Data

[63] Continuation-in-part of Ser. No. 12,438, Feb. 9, 1987, abandoned.

[51] Int. Cl.[5] ..... D05B 27/22

[52] U.S. Cl. ..... 112/315; 112/DIG. 3

[58] Field of Search ..... 112/315, 316, DIG. 3

[56] References Cited

U.S. PATENT DOCUMENTS

| | | | |
|---|---|---|---|
| 2,577,705 | 12/1951 | Hoffmeister | 112/315 |
| 2,643,625 | 6/1953 | Keimer | 112/315 |
| 3,392,692 | 7/1968 | Reimer | 112/315 |
| 4,296,700 | 10/1981 | Jehle et al. | 112/315 X |

FOREIGN PATENT DOCUMENTS

| | | | |
|---|---|---|---|
| 456235 | 8/1913 | France | 112/315 |
| 688957 | 3/1953 | United Kingdom | 112/315 |

*Primary Examiner*—Wm. Carter Reynolds
*Attorney, Agent, or Firm*—Darby & Darby

[57] ABSTRACT

A chain stitch sewing machine has a movable stitch eccentric shaft for switching between a bunch stitch and a long stitch and a rotatable main drive shaft. A mechanism is mounted on the main drive shaft for rotation therewith to move the eccentric shaft to effect the switching from the switch to the other while the machine is in operation.

6 Claims, 3 Drawing Sheets

FIG.3
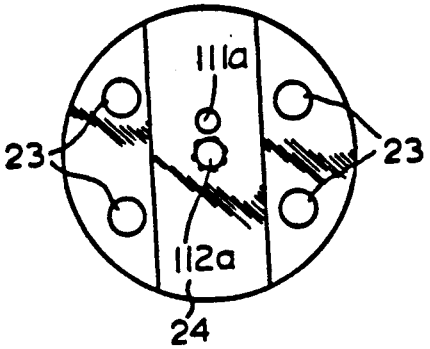
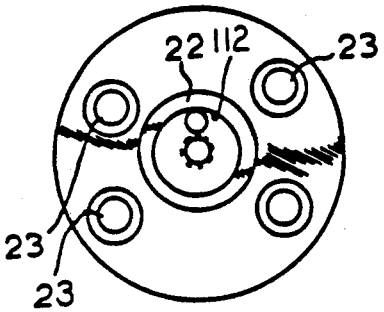
FIG.4
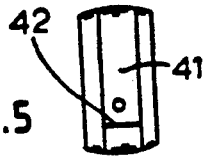
FIG.5
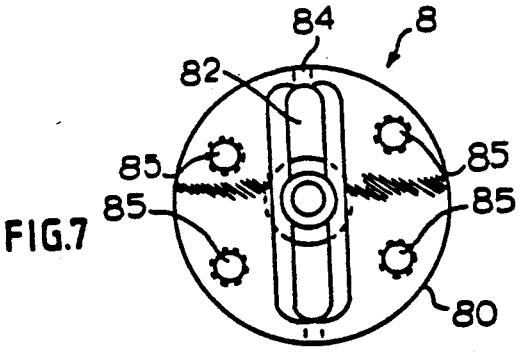
FIG.7
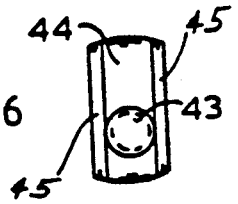
FIG.6
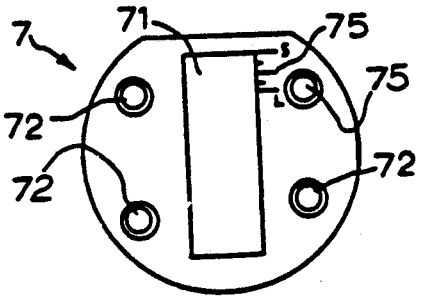
FIG.8

STITCH SWITCHING MECHANISM FOR A CHAIN STITCH SEWING MACHINE

RELATED APPLICATIONS

This application is a continuation-in-part of my copending application Ser. No. 12,438, filed 9 Feb. 1987, entitled Stitch Switching Mechanism For A Chain Stitch Sewing Machine now abandoned.

BACKGROUND OF THE INVENTION

The present invention relates to a chain stitch sewing machine and in particular to a device for switching between a long stitch and a bunch or short stitch.

In chain stitch sewing machines of the conventional type, a switch eccentric shaft is provided for switching the machine between a long stitch and a short or bunch stitch. By varying the relative displacement between the axis of a main shaft and the axis of the eccentric shaft, the stroke of a feed dog is varied and the stitch length is effectively controlled, as shown for example in U.S. Pat. No. 3,392,692 to Reimer. This switching is usually accomplished by the operator. However, the switching operation takes the machine out of operation to effect the changeover.

SUMMARY OF THE INVENTION

The main object of the present invention is to provide a mechanism mounted on the main shaft of a conventional chain stitch sewing machine for moving the stitch eccentric shaft during the operation of the machine to effect a switch over from one stitch to the other.

These and other objects of the present invention are achieved in accordance with the present invention by means mounted on the main shaft of the sewing machine for rotation with the main shaft.

The operator can actuate the mechanism to effect movement of the eccentric shaft to switch the machine from a long stitch to a bunch stitch while the machine is in operation and the main shaft is rotating. This is carried out by a hollow bore air-cylinder which is fixedly mounted relative to the main shaft, and a cam connected with the cam follower. The cam is rotated with the main shaft and is moved by the cylinder. An eccentric shaft is movable with the cam follower. The cam follower is normally biased by a spring loaded plunger screw to maintain the cam follower normally in the long stitch position. Upon the actuation of an electric eye or other switch, the cylinder is activated and it pushes against the cam follower to move the cam follower into the short stitch position against the force of the plunger screw. When air to the cylinder is shut off, the cylinder retracts to permit the plunger screw to push the cam follower back to the long stitch position. An electric eye can be placed on the sewing machine to actuate the machine from the long stitch to the short stitch position when no fabric is present.

These and other objects and advantages of the present invention will become apparent from the following description of the present invention taken with the attached drawings wherein:

BRIEF DESCRIPTION OF THE DRAWINGS

FIGS. 3 and 4 are rear and front views of the adaptor shown in FIG. 2;

FIGS. 5 and 6 are rear and front views of the cam follower of FIG. 2;

FIG. 7 is a front view of the shaft of FIG. 2; and

FIG. 8 is a front view of the face plate of FIG. 2.

DETAILED DESCRIPTION OF THE INVENTION

Figure 1:
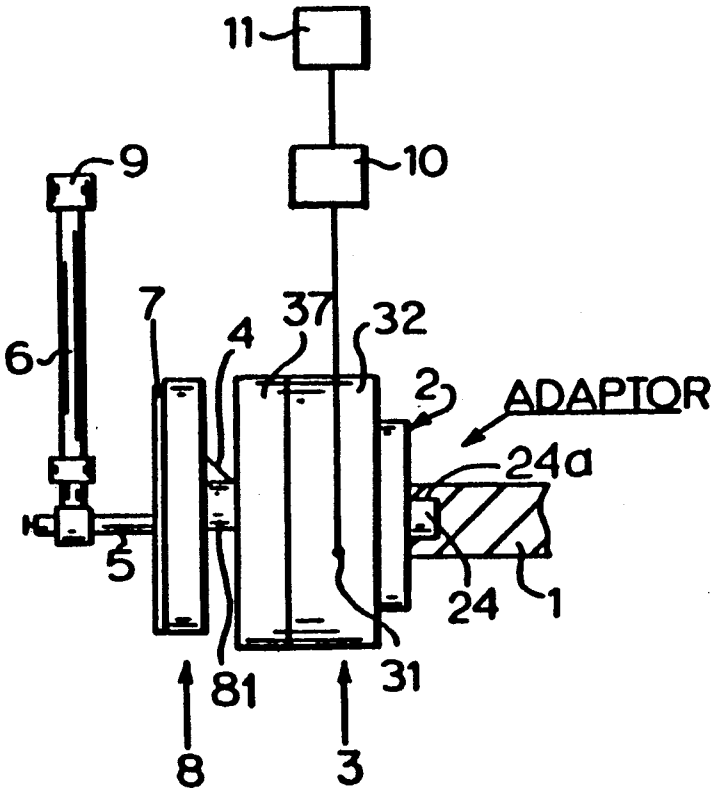
FIG. 1 is a schematic view of the mechanism in accordance with the present invention.

Referring now to FIG. 1, the mechanism according to the present invention includes a unit connected to the main drive shaft 1 of a sewing machine. The unit includes an adaptor 2 which mounts the unit to the main drive shaft for rotation therewith. The unit also includes a hollow bore air cylinder 3, a shaft 81, a cam follower 4, a face plate 7 and an eccentric shaft 5 connected to the cam follower 4. Connected to the eccentric shaft 5 is a linkage 6 having an adaptor 9 at the end thereof for connecting to the sewing machine element, typically a feed dog, which, in turn, is moved to effect movement from the long stitch to a short stitch.

The mechanism further comprises a controllable air supply 10 which is connected to an air input 31 of the hollow bore cylinder. The air supply is controlled by a photoelectric eye 11 which senses when fabric is absent or present on the sewing machine. During the presence of fabric on the sewing machine, the air supply 10 is off and the cam follower is maintained by a spring loaded plunger screw 83 (FIG. 2) in the long stitch position. Upon sensing the absence of fabric, air supply 10 is turned on and the hollow bore cylinder 3 is activated, and pushes against the cam follower at the angle cut portion 42 thereof. This pushes the cam follower into the short stitch position against the force of the plunger screw 83. When the air to the cylinder is shut off, i.e., when fabric is sensed, the cylinder retracts which allows the plunger screw to push the cam follower back to the long stitch position.

Figure 2:
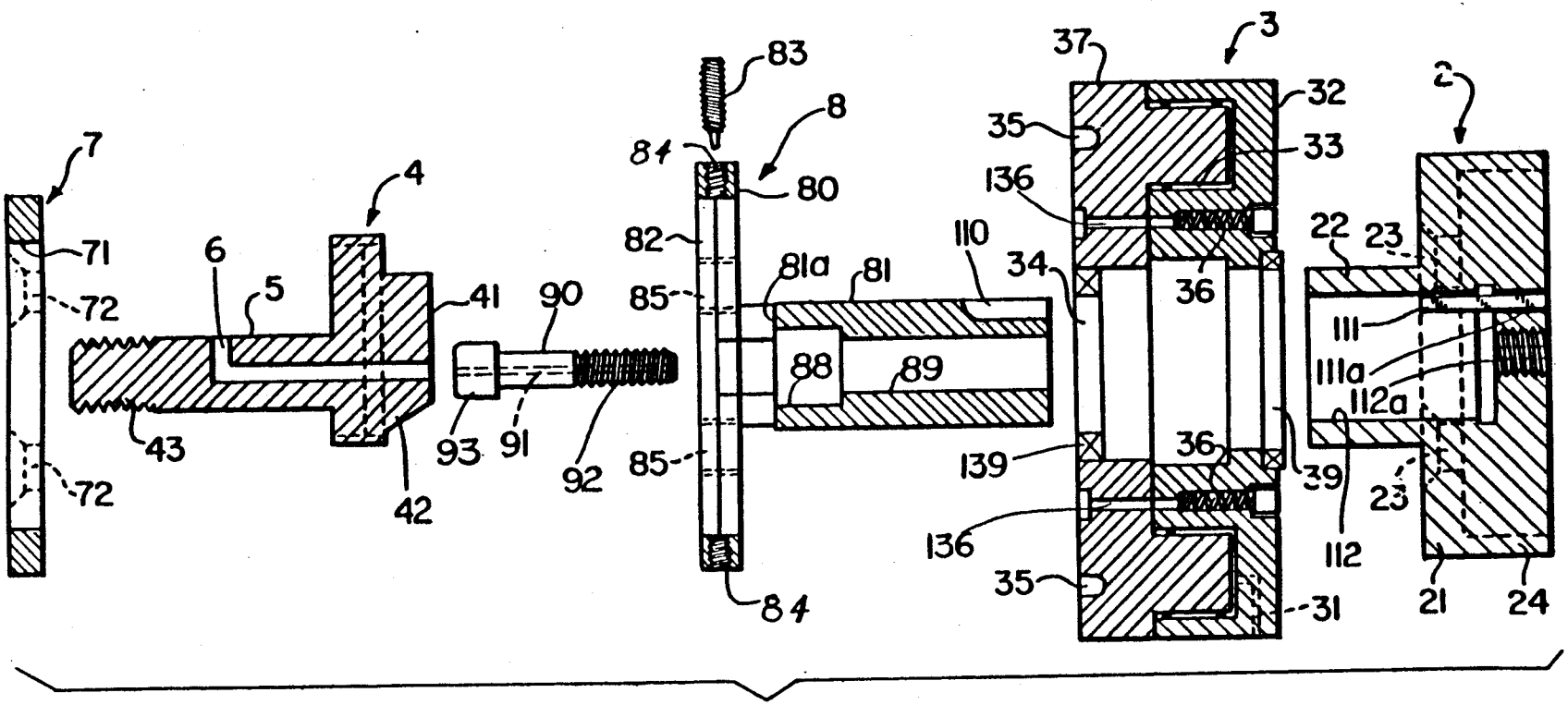
FIG. 2 is the exploded view of the mechanism shown in FIG. 1.

FIG. 2 shows a detailed exploded view of the unit of FIG. 1. The hollow bore cylinder 3 has a stepped inner bore 34. A ball bearing race 39 is received at the rear end of the bore and a ball bearing race 139 is received at the front end of the bore. The races are rotatable relative to the two portions 32 and 37 comprising the cylinder. Springs 36, connected to the respective ends of associated screws 136 maintain the cylinder in the closed position as shown. An air inlet 31 is provided. When air is received through the inlet 31, the air fills the air chamber 33 between the portions 32 and 37. Accordingly, portion 37 will move forwardly to cause the race 139 to bear against the cam edge 42 as noted in greater detail below.

An adaptor 2 is provided to connect the stitch control of the present invention with the drive shaft of the associated sewing machine. The adaptor 2 is shown in greater detail in FIGS. 2, 3 and 4. The adaptor includes a wheel 21 with a blade extension 24 on the rear thereof which is formed complimentary to a slot **24*a* on the drive shaft 1 (FIG. 1) and is received in such slot so that the adaptor rotates with the drive shaft. The adaptor is provided with a forwardly extending portion 22 which is received in a press fit in the race 39 and is rotatable with the race. The adaptor further includes a central bore 112 and a centrally located smaller diameter threaded opening 112*a* at the rear thereof. The adaptor is further provided with screw holes 23 to connect the adaptor to the main shaft 1 (FIG. 1**).

A cam follower holder 8 is also provided that includes a rearwardly extending shaft 81 connected to a radial plate 80. The shaft 81 includes a recess 110 at the rear end thereof and a through bore having an enlarged diameter front portion 88 and a narrow diameter end portion 89. A threaded hole 84 is provided in the plate 80 which receives the plunger screw 83 therein. A threaded opening 86 at the opposite end receives a conventional set screw therein. A member 90 is similarly provided and includes a threaded end portion 92 and an enlarged head 93. An oil hole 91 extends through the member 90.

When the elements are assembled, as noted above, the portion 22 of the adaptor 2 is received in the race 39 in a press fit. On the other hand, the shaft 81 of cam follower holder 80 is received in sliding engagement with the race 139. The shaft portion 81 extends through the bore 34 in the cylinder 3 and is supported by the race 139 for rotatable movement with respect thereto. The shaft 81 further extends into the opening 112 in the adaptor 2. A pin 111 is received in a locating bore **111*a* in the adaptor and extends into the recess 110 of the shaft 81 so that the adaptor 2 and the shaft 81 are in locked driving engagement with each other. The member 90 extends through the openings 88 and 89 and the threaded end 92 is engaged in the threaded bore 112*a* of the adaptor so that it connects and maintains together the cam follower holder 8 and the adaptor 2. The member 90 is screwed into place until the head 93 abuts the shoulder between the openings 88 and 89. A bracket (not shown) connects the portion 32 of the cylinder 3 to the sewing machine. Accordingly, the cylinder 3 is maintained nonrotatable while the drive shaft 1 rotates the holder 8 via the adaptor 2. Moreover, the portion 37 of the cylinder 3 is free to move toward and away from the portion 32**.

The cam follower 4 rides in a slot 82 in the plate 80 and the rear surface 41 of the cam follower 4 abuts against the surface **81*a* of the shaft 81. The cam follower 4 also includes a forwardly extending shaft 5 having a threaded end 43 adapted to be threadedly connected to the member 6 of the sewing machine. The shaft 5 is also provided with an oil hole 46. The cam follower 4 is also provided with vertical side flanges 46 (FIG. 6) that are received in complimentary formed vertically extending recesses in the front surface of the plate 80 to support the cam follower 4 for movement with respect thereto. The elements are sized and positioned so that the cam surface 42 will extend behind the rear surface of the plate 80. In other words, since the surface 41 abuts the surface 81*a* of the shaft 81, the cam surface 42 will extend beyond the rear surface of the plate 80**.

A face plate 7 is provided having indicia thereon such as 75 (FIG. 8). The face plate 7 is provided with a slot 71 that receives the shaft 5 therethrough. However, the slot 71 is of slightly smaller width than the width of the side flanges 45 so that the face plate 7 will overlie the flanges 45 on the cam follower 4 to maintain the cam follower 4 in place in the plate 80. Appropriate screws (not shown) extend through openings 72 in the face plate 80 and are engaged in threaded holes 85 in the plate 80.

In operation, the plunger screw 83 and the corresponding set screw in the threaded opening 84 are initially set to position the shaft 5 for the desired eccentricity to make a long stitch. That is, as shown in FIG. 2, the shaft 5 is off-set with respect to the center of the adapter 2. Accordingly, the shaft 5 is initially set so that it is at the desired off-set with respect to the center of the drive shaft 1.

When it is desired to make a short stitch, air is applied through the air passage 31 to the air chamber 33. Since the portion 32 of the cylinder 3 is rigidly connected to the sewing machine, the portion 37 rides forwardly on the shaft 81, it being understood that the elements are sized so that the surface **81*a* is normally positioned externally of the portion 37** when no air pressure is applied.

As the member 37 rides forwardly, the race 139 engages the cam surface 42 to move the cam follower 4 against the bias of the plunger screw 83. Accordingly, the shaft 5 will be moved toward the center of the shaft 81 or the center of rotation of the elements thereby decreasing the eccentricity and causing the machine to change the length of the stitch through the linkage 6. That is, the shaft 5 will traverse a smaller circle than that for the other position of the cam follower.

It will be appreciated that the instant specification and claims are set forth by way of illustration and not limitation and that various modifications and changes may be made without departing from the spirit and scope of the present invention.

What is claimed is:

1. In a chain stitch sewing machine having a movable stitch eccentric shaft for switching between a bunch stitch and a long stitch and rotatable main drive shaft, the improvement comprising means mounted on the main shaft for rotation therewith and for moving the eccentric shaft relative to the main shaft to effect a switching from one stitch to the other while the machine is in operation, the means for moving comprising a cam follower connected to the eccentric shaft, means normally biasing the cam follower in one position corresponding to one stitch and activatable means for moving the cam follower to a second position corresponding to the other stitch, said activatable means comprising a stationary hollow bore air cylinder with a rotatable bearing, a shaft extending through the cylinder and receiving the cam follower therein, whereby air supplied to said cylinder causes at least a portion of said cylinder to engage and move said cam follower to thereby move the eccentric shaft to another position to change the switch length.

2. The machine as in claim 1, wherein the biasing means comprises a spring loaded plunger screw.

3. The machine according to clam 2, further comprising means for activating the air cylinder comprising a controllable air supply connected to the air cylinder and a switch for controlling same.

4. The machine according to claim 3, wherein the switch comprises an electric eye for sensing the presence and absence of fabric on the sewing machine.

5. The machine according to claim 1, wherein said cam follower is slidable with respect to said main shaft, and has an angled edge engageable with a surface to affect sliding movement of said cam follower.

6. The machine according to claim 5, wherein said surface is moveable into engagement with said angled edge, and further comprising moving means connected with said surface for moving said surface into engagement with said edge.

* * * * *